United States Patent [19]

Schenach

[11] 4,035,308

[45] July 12, 1977

[54] MONOALKYL BENZENE SYNTHETIC LUBRICANT

[75] Inventor: Thomas Anthony Schenach, Huntington Beach, Calif.

[73] Assignee: Bray Oil Company, Los Angeles, Calif.

[21] Appl. No.: 606,475

[22] Filed: Aug. 21, 1975

[51] Int. Cl.[2] ..... C10M 1/16; C10M 3/10; C10M 5/08; C10M 7/12

[52] U.S. Cl. ..... 252/59; 252/73; 260/671 B; 260/671 G

[58] Field of Search ..... 252/32.7 E, 59, 74, 252/73; 260/671 G

[56] References Cited

U.S. PATENT DOCUMENTS

| | | | |
|---|---|---|---|
| 2,810,769 | 10/1957 | Sanford et al. | 252/59 X |
| 3,173,965 | 3/1965 | Pappas et al. | 252/59 X |
| 3,367,865 | 2/1968 | Gudelis | 260/671 G |
| 3,732,167 | 5/1973 | Foucher et al. | 252/32.7 E |
| 3,732,324 | 5/1973 | McGuire et al. | 260/671 G |
| 3,733,850 | 5/1973 | Olund | 252/59 |
| 3,758,624 | 9/1973 | Perilstein | 260/671 G |
| 3,766,285 | 10/1973 | Boggs et al. | 260/671 G |
| 3,767,577 | 10/1973 | Boggs | 252/59 |
| 3,780,128 | 12/1973 | Shubkin | 252/59 |
| 3,808,134 | 4/1974 | Romine | 252/59 |
| 3,812,036 | 5/1974 | Romine | 252/59 |
| 3,834,166 | 9/1974 | Cupper et al. | 252/59 |
| 3,923,669 | 12/1975 | Newingham et al. | 252/32.7 E |

*Primary Examiner*—Delbert E. Gantz
*Assistant Examiner*—Irving Vaughn

[57] ABSTRACT

Monoalkylbenzene synthetic lubricant formed by reacting decene dimer with excess benzene in presence of anhydrous aluminum chloride.

4 Claims, No Drawings

MONOALKYL BENZENE SYNTHETIC LUBRICANT

This invention relates to a synthetic alkyl benzene hydrocarbon composition useful in the formulation of lubricants and power transmission oils.

BACKGROUND

The Friedel-Crafts alkylation of benzene has been widely employed as a method of producing synthetic lubricant base oils. The dialkyl benzenes, $R_1—C_6H_4R_2$, wherein $R_1$ and $R_2$ are alkyl groups containing from 8 to 18 and more usually from 10 to 15 carbon atoms and $C_6H_4$ represents the benzene nucleus, have received the most attention, inasmuch as they are produced as by-products during the manufacture of sodium alkyl benzene sulfonate laundry detergents. Originally, the alkyl substituents were derived from propylene tetramers and similar highly branched olefins; and, as a consequence of this branching, the dialkyl benzenes, while possessing good thermal stability, had extremely poor viscosity-temperature characteristics, as illustrated by viscosity indexes generally below zero. More recently, linear alpha-olefins and linear monochlorinated paraffins have replaced tetrapropylene in the alkylation, and many of the resulting dialkyl benzenes have good viscosity indexes as well as good thermal stability and low temperature properties. Representative properties of dialkyl benzene base oils are: viscosities at 210°F. of from 4 to 6 centistokes; viscosity indexes of around 100; pour points below −40°; flash points have above 400° F. Among the many references to the preparation and use of dialtyl benzenes are Bray et al, U.S. Pat. Nos. 3,478,113; Bray et al, 3,544,472; Pappas et al, 3,173,965; Becraft et al, 3,288,716; and Feighner et al, 3,662,012. The many applications found for these products include power transmission oils, hydraulic fluids, automobile crankcase oils, especially for automobiles operating in exceptionally cold climates, and gas turbine lubricants, where high temperature stability is important.

Monoalkyl benzenes, on the other hand, are not as generally useful in such applications as their dialkyl benzene counterparts. One of the main problems is their poor low temperature properties. For example, Pappas et al, in U.S. Pat. No. 3,173,965 describe a di—$C_{10}$—$C_{15}$ alkyl benzene with a pour point of below 75° F. On the other hand, the same workers prepared two mono-$C_{18}$-alkyl benzene and 1-octadecone, and found pour points of +23° F. and −7° F. respectively, even though the two monoalkyl benzenes had lower molecular weights, lower viscosities at 210° F. and higher viscosity indexes than the di—$C_{10}$—$C_{15}$ alkyl benzene above. Lower molecular weight monoalkyl benzenes such as tridecyl benzene have better low temperature properties but their relatively low flash points (300°–350° F.) and viscosities (from 1.5 to 3 centistokes at 210° F.) make them unsuitable for high temperature applications for which the dialkyl benzenes can be used.

THE INVENTION

I have now discovered a novel monoalkyl benzene hydrocarbon composition that is comparable to, and in some respects superior to, the conventional dialkyl benzenes described hereinabove. I prepare this composition by adding decene dimer prepared by oligomerizing 1-decene in the presence of a promoted boron trifluoride catalyst to an excess of benzene in the presence of anhydrous aluminum chloride. The resulting decene dimer-benzene alkylate has viscosities in the range of 4 to 6 centistokes at 210°10F., a viscosity index around 100, a flash point above 400° F., and a pour point below −40° —properties similar to those of the dialkyl benzenes. Moreover, the oxidation stability of my synthetic hydrocarbon composition is superior under certain conditions to that of conventional dialkyl benzenes.

PRIOR ART

The closest prior art I am able to locate to the composition of my invention is H. H. Eby et al, U.S. Pat. Nos. 3,410,925, and 3,732,324 to McGuire et al. Eby teaches a method of preparing an alkyl benzene especially useful in the manufacture of oil soluble sulfonates by dimerizing a branched or straight-chain olefinic hydrocarbon containing from 3 to 18 carbon atoms, using either mineral acid or an aluminum chloride catalyst sludge as dimerization catalyst, and reacting the resulting dimer with an aromatic hydrocarbon, preferably benzene or toluene. McGuire also teaches a method for preparing an oil-soluble sulfonate feedstock, the method comprising contacting one or more highly branched olefinic compounds containing from 20 to 36 carbon atoms with a monocyclic aromatic compound in the presence of nitromethane-moderated aluminum chloride. The highly branched olefinic compound is preferably a dimer of tetrapropylene, prepared by contacting tetrapropylene with a polymerization catalyst. The aromatic compound is preferably benzene, although toluene and xylene can also be employed. Neither reference discloses a synthetic lubricant compositio suitablle over the wide range of temperatures at which my decene-dimer benzene dimer may be employed. Both references are directed not to lubriants but to the problem of making sulfonation feedstocks. It is well known that, whereas a large variety of alkylated aromatics can be sulfonated to yield oil-soluble sulfonates, relatively few of them can be usefully employed as synthetic lubricants. For example, the dialkyl benzenes based on tetrapropylene and the mono-$C_{18}$-benzene prepared by Pappas from octadecene may both be sulfonated to yield oil-soluble sulfonates, although neither is suitable as a Synthetic lubricant for reasons already given hereinabove. Thus, neither reference can be said to anticipate or lead to my synthetic lubricant composition. Moreover, McGuire is directed to the use of highly branched olefins and a nitromethane-modified aluminum chloride alkylation catalyst. Eby teaches a mineral acid or aluminum chloride sludge dimerization catalyst, and moreover considers benzene and toluene to be equally useful in his invention. Somewhat surprisingly, the substitution of toluene for benzene in my invention yields an oil of much inferior quality, as will be shown hereinbelow. For these reasons, I believe that my compositions are novel and patentable over the above art.

DETAILED DESCRIPTION OF THE INVENTION

1. Reactants.

The term "decene dimer" is employed in the instant application to designate that mixture of $C_{20}$ olefinic compounds prepared by the oligomerization of n-decene-1 in the presence of a promoted boron trifluoride catalyst. As is well known, decene can be polymerized by a variety of catalyst to yield dimers, trimers, tetramers, pentamers, and higher oligomers that, when hydrogenated to remove residual unsaturation, have found extensive use as synthetic lubricants and hydraulic fluids. Processes for preparing such decene oligomer oils are disclosed by many workers, including Brennan, U.S. Pat. Nos. 3,769,363; Hamilton et al, 3,149,178; Pratt, 3,842,134; and Brennan, 3,742,082. The decene dimers formed by such processes differ, sometimes dramatically, in their properties and utility, depending on the catalyst and reaction conditions chosen. Thus, dimers prepared by the use of peroxide or Ziegler catalysts yield oils with objectionably high pour points upon hydrogenation, mainly because of the presence therein of n-eicosane, n-$C_{20}H_{42}$, which melts at 100° F. Dimers prepared by the use of water or phosphoric acid-promoted boron trifluoride catalysts, on the other hand, do not yield n-eicosane on hydrogenation and have very good low temperature properties (See Brennan, U.S. Pat. No. 3,742,082). Likewise, the use of carboxylic acid-promoted $BF_3$ catalysts, such as the $BF_{-3}$-valeric acid catalyst of Brennan, U.S. Pat. NO. 3,769,383, also yields decene dimer which on hydrogenation has a low pour point (below -80° F.). The use of modified aluminum chloride catalysts, such as those of Pratt, U.S. Pat. No. 3,842,134, also produces decene dimer with a low pour point after hydrogenation, but these dimers contain a substantial amount of naphthenic $C_{20}$ compounds which, because of the absence of olefinic unsaturation, is less reactive with benzene under alkylation conditions. Hence, I prefer to use decene dimer from the promoted $BF_3$ polymerizations, especially $BF_3$-carboxylic acid-catalyzed polymerizations which is substantially all $C_{20}$ olefins, as indicated by the bromine number. Such dimer, while varying slightly in properties depending on the carboxylic acid promoter, and the reaction conditions, will have the following characteristics:

Viscosity at 100° F. between 4.5 and 6 centistokes.

Bromine number above 50 (Theoretical 57).

Pour Point (both before and after hydrogenation) below -80° F.

The preferred catalyst in the preparation of the decene-dimer benzene alkylate of my invention is anhydrous aluminum chloride, because of its reactivity and commercial availability. Suitable alternates would be Friedel-Crafts catalysts of comparable reactivity such as aluminum bromide and perhaps hydrogen fluoride. The aluminum chloride could also be generated in situ by the reaction of aluminum metal with anhydrous hydrogen chloride. Benzene is the preferred aromatic compound for use in my invention. Somewhat surprisingly, toluene, which is more reactive than benzene in alkylation reactions, yields a product with considerably poorer viscosity-temperature characteristics.

2. Reaction Conditions

The decene-dimer benzene alkylate of my invention is prepared by the addition of decene dimer to a rapidly stirred slurry of aluminum chloride in an excess of dry benzene. I normally prepare the slurry at room temperature, and allow the reaction exotherm to raise the batch temperature to about 120°–160° F. Inasmuch as a monoalkylated product is desired, I use a substantial excess of benzene — at least 2 moles of benzene to one mole of the dimer. The viscosity of the final product decreases as higher excesses of benzene are employed, as will be shown in the Examples below. The viscosity index, however, remains the same. Thus, I can adjust the viscosity to some extent without adversely affecting the viscosity index — a useful advantage to my invention. I have found that the amount of aluminum chloride catalyst should be at least 0.04 moles per mole of benzene. Otherwise, the final product will have a bromine number greater than one, indicating the presence of decene tetramer or other polymers of the starting decene dimer. THese adversely affect the oxidation stability of my alkylate. The agitation must be vigorous enough to keep the particles of aluminum chloride well mixed with the liquid reactants. Failure to maintain sufficient agitation will also result in a high bromine number. Whereas in other Friedel-Crafts processes, many workers recommend the addition of trace amounts of promoters such as hydrogen chloride or water to the aluminum chloride, I have not found it necessary in preparing my decene-dimeter benzene alkylate. The traces of moisture present in my reactants are apparently sufficient to promot my reaction, if indeed such promotion is necessary.

The isolation of the product from my reaction mixture is carried out by conventional procedures such as are normally employed in aluminum chloride reactions. When the reaction itself seems to be essentially complete, the mixture is allowed to stand without agitation, whereupon the spent aluminum chloride rapidly settles to the bottom in the form of a reddish fluid sludge. This sludge is removed, and the reaction mixture is washed with aqueous alkali, for example, 10% sodium hydroxide, in order to remove residual aluminum salts and HCl. The reaction mixture is usually washed again, this time with water, to remove residual caustic, and then subjected to vacuum or steam distillation in order to remove unreacted benzene and decene dimer and any low boiling by-products. The product of my invention is obtained as the "bottoms" fraction, boiling above about 200° C. at 1–2 mm of mercury. Generally, it has a greenish brown appearance after the distillation, and is treated with a small amount — e.g. 3% by weight — of an activated clay to improve the color. The yield, based on the weight of decene dimer charged, is usually over 70%, and sometimes over 80°.

3. Applications

The decene dimer-benzene alkylate of my invention is useful in the formulation of lubricating products and power transmission oils where a combination of high temperature stability and good low temperature properties are desired. One such application is in the field of automobile crankcase oils for engines operating near-arctic climates, where an engine oil must flow at temperatures of -30° F. or below, yet lubricate and protect at normal engine operating temperatures of 250°–300° F. Another application is in gas turbine lubricants, where the oil must protect at tempratures above 300° F. but must also flow at the low temperatures which may prevail in the area where the turbine is installed. Lubricating and hydraulic oil additives which are compatible with conventional petroleum base oils or with conventional dialkyl benzene oils, such as zinc dithiophosphate and tricresyl phosphate antiwear agents, polybutene and polyacrylate viscosity index improvers, calcium sulfonate and calcium overbased sulfonate corrosion inhibitors and detergents, and so on, are also compatible with the composition of my invention. Some illustrative embodiments are shown in the Examples below.

EXAMPLES

Preparations and uses of the decene dimer-benzene alkylate of my invention are illustrated by the following examples. In these experiments, kinematic viscosities were determined in a Cannon-Fenske viscosimeter, according to ASTM Method D-445. Viscosity indexes were determined by ASTM Method D-2270, and bromine numbers by ASTM Method D-1158. Flash and fire points were determined in the Cleveland open cup (COC) apparatus, ASTM Method D-92.

EXAMPLE ONE

A mixture of 1950 grams of dry benzene (25 moles) and 133 grams of anhydrous aluminum chloride (1 mole) was slurried at 76° F. with vigorous agitation, and 2715 grams of decene dimer (9.7 moles) was slowly added. The temperature rose to 145° F. in 20 minutes and was maintained at around 120°– ° F. by intermittent cooling. After addition of the decene dimer, which required about 90 minutes, the reaction mixture was stirred for an additional 1½ hours and allowed to settle. The aluminum chloride separated in the form of a viscous reddish sludge and was removed; the crude reaction mixture was washed with dilute caustic to remove residual aluminum salts and HCl, water-washed to remove excess caustic, and then distilled, first at atmospheric pressure to remove excess benzene, then under vacuum to remove unreacted decene dimer. The resulting alkylate, boiling above 200° C. (392° F.) at 1.5 mm of mercury, was clay-treated to improve the color. A total yield of 1957 grams of oil was obtained with the following properties:

| | | |
|---|---|---|
| API Gravity | 32.6 | |
| Viscosity at 210° F. | 5.14 | centistokes |
| Viscosity at 100° F. | 31.45 | centistokes |
| Viscosity at −40° | 24000 | centistokes |
| Viscosity Index | 101 | |
| Flash Point | 430° F. | |
| Fire Point | 455° F. | |
| Bromine Number | 0.7 | |
| Yield | 72% | (based on grams of dimer charged) |

The decene dimer used in Exampple 1 was prepared by the polymerization of n-1-decene at 50° F. using a boron trifluoridecarboxylic acid complex as the catalyst. It has a boiling point range of about 120°–175° C./1 mm., a pour point below −80° F., a viscosity of 5.6 centistokes at 100° F., and a bromine number of 55.

EXAMPLE TWO

In this run, 630 grams of decene dimer (2.25 moles) from a different polymerization was added to a slurry of 27 grams aluminum chloride (0.2 moles) in 390 grams of benzene (5 moles). The reaction temperature was 140° F., the total reaction time 2½ hours. The product had the following properties:

| | | |
|---|---|---|
| API Gravity | 33.2 | |
| Viscosity at 210° F. | 5.16 | centistokes |
| Viscosity at 100° F. | 30.96 | centistokes |
| Viscosity at −40° | 16200 | centistokes |
| Viscosity Index | 99 | |
| Bromine Number | 0.9 | |
| Yield | 85% | |

The use of a different batch of decene dimer did not markedly affect most of the properties of the product but may have improved the yield and the −40° viscosity.

EXAMPLE THREE

This run illustrates the curious fact that toluene, substituted for benzene, gives a product that is markedly inferior in its viscosity-temperature characteristics to that obtained from benzene itself. In this experiment, 630 grams of decene dimer was added to a slurry of 27 grams alunimum chloride in 460 grams (5 moles) of tolune. Reaction conditions and workup were similar to those employed in Example Two, but the product had the following properties:

| | | |
|---|---|---|
| Viscosity at 210° F. | 4.53 | centistokes |
| Viscosity at 100° F. | 27.28 | centistokes |
| Viscosity Index | 79 | |
| Bromine Number | 1.6 | |

Note that the viscosity index was 20 units lower than that shown by the decene-dimer benzene alkylates of Examples One and Two.

EXAMPLE FOUR

This run illustrates the lower viscosity product obtained when higher benzene/decene dimer ratios are employed. In this experiment, 1054 grams (3.76 moles) of decene dimer were added to a slurry of 85 grams (0.65 moles) aluminum chloride in 1170 grams (15 moles) of dry benzene at 140° F. over a period of 1½ hours. The product (880 grams) had a viscosity of 4.37 centistokes at 210° F. and 23.86 centistokes at 100° F. (Viscosity Index 100). Its bromine number was 0.3.

EXAMPLE FIVE

This example shows the use of the synthetic hydrocarbon of my invention in the formulation of an automobile crankcase lubricant. A commercially available crankcase oil additive package, L-3817 (manufactured by the Librizol Corporation, Cleveland, Ohio) was added in the recommended 10.8 weight percent concentration to the product oil of Example One to from a crankcase oil with the following properties:

| | | |
|---|---|---|
| Viscosity at 210°F. | 6.36 | centistokes |
| Viscosity at 100° F. | 42.32 | centistokes |
| Viscosity at 0° F. | 2222 | centistokes |
| Viscosity Index | 108 | |
| Analysis: | | |
| Zinc | 0.09 | wt. % |
| Calcium | 0.2 | wt. % |
| Sulfur | 0.27 | wt. % |
| Phosphorus | 0.08 | wt. % |
| Alkali Value | 6.05 | mg. KOH equiv./gram |

According to the Society of Automotive Engineers' viscosity classification system, this oil is an SAE 10W-20.

EXAMPLE SIX

Comparison With Conventional Dialkyl Benzene Oils

In this experiment, the decene-dimer benzene alkylate of my invention was formulated into a turbine oil by the addition of appropriate additives. This turbine oil had a viscosity of 35.39 centistokes at 100° F. and a viscosity index of 102. For purposes of comparison, another turbine oil formulation was prepared by adding the same additives to a conventional dialkyl benzene synthetic hydrocarbon oil, prepared by alkylating benzene with a linear monochlorinated paraffin containing 10–13 carbon atoms, removing monoalkyl benzene by distillation, and acid-treating the bottoms with fuming sulfuric acid, as described in Bray et al, U.S. Pat. No. 3,544,472, and Bray et al, U.S. Pat. No. 3,478,113. This turbine oil formulation had a viscosity of 33.79 centistokes at 100° F. and a viscosity index of 104.

The two oils were compared by means of the 72 hour 347° F. "five metal" corrosion-oxidation stability test. This procedure is described in Federal Test Method Standard No. 791B, Method 5308, and is basically carried out as follows: polished specimens of copper, steel, aluminum, magnesium, and silver are tied together into a box and immersed in the oil to be tested, and a slow stream of air is bubbled through at a prescribed rate while the oil is maintained at the test temperature for the required period. When the test period is completed, the oil and metals are examined for evidence of oxidative degradation — for example, a large increase or decrease in oil viscosity, a large deposit of sludge, corrosive attack on one or more of the metal specimens. Using this procedure, the decene dimer-benzene alkylate formulation of my invention was found to show an increase in viscosity of 20.11% measured at 100° F. The conventional dialkyl benzene formulation was found to show a viscosity increase of 39.13%. There was no corrosive attack on the metals and no significant amount of sludge from either formulation.

This example illustrates that my synthetic hydrocarbon composition is superior in oxidation stability to conventional dialkyl benzene lubricants; at least, in some formulations.

As would be obvious to workers skilled in the art, the composition of my invention in admixture with appropriate additives may be employed in many types of lubricating oils and power transmission oils, such as gear oils, automatic transmission fluids, and the like. By the addition of thickeners such as the calcium, lithium, and sodium salts of fatty acids, bentonite, silica gel, and other modified clays, ureas, and so on, the decene dimer-benzene alkylate may be converted to greases. It may be subjected to catalytic hydrogenation in order to improve its oxidation stability, as taught by Pappas et al, U.S. Pat. No. 3,173,965, for the dialkyl benzenes. The examples given hereinabove are furnished for the purpose of illustration only, and are not meant to be limiting within the boundaries of the following claims.

I claim:

1. A synthetic hydrocarbon composition useful in the formulation of lubricants and power transmission fluids, said synthetic hydrocarbon being prepared by the addition of decene dimer to excess benzene in the presence of anhydrous aluminum chloride, and possessing the following properties:

a. A viscosity at 210° F. of from about 4 to 6 centistokes;
b. A viscosity index of about 100;
c. A flash point above 400° F.;
d. A pour point below −40°; and
e. A bromine number less than one.

2. A method of making the synthetic hydrocarbon lubricant composition of claim 1 which comprises the following steps:

a. Forming a slurry of anhydrous aluminum chloride in benzene, said slurry containing at least 0.04 mole of aluminum chloride for each mole of benzene;
b. Adding thereto decene dimer prepared by the oligomerization of n-decene-1 in the presence of a promoted boron trifluoride catalyst, the ratio of benzene to decene dimer being at least 2 moles of benzene per mole of decene dimer; and
c. Removing the aluminum chloride sludge and distilling the reaction mixture in order to remove from the synthetic hydrocarbon product unreacted benzene and decene dimer.

3. The method of claim 2 wherein the decene dimer is added to the benzene-aluminum chloride slurry at a temperature of from 120° to 160° F.

4. In an improved automobile crankcase lubricant suitable for low temperature conditions and comprising a major proportion of a lubricating oil base and, in amounts sufficient to achieve each additive's attendant function, conventional crankcase lubricating oil additives, the improvement wherein the lubricating oil base comprising a synthetic hydrocarbon composition with a 210° F viscosity of from about four to six centistokes, a viscosity index of about 100, a pour pont below −40°, and bromine number less than one, said hydrocarbon composition being prepared by the addition of decene dimer to excess benzene in the presence of anhydrous alunimum chloride, said decene dimer having a 100° F viscosity of between 4.5 and 6 centistokes, a bromine number above 50, and a pour point before and after hydrogenation of below −80° F, said dimer being prepared by the oligomerization of n-dencene-1 in the presence of a promoted boron trifluoride catalyst.

* * * * *

UNITED STATES PATENT OFFICE

CERTIFICATE OF CORRECTION

Patent No. 4,035,308 Dated July 12, 1977

Inventor(s) Thomas Anthony Schenach

It is certified that error appears in the above-identified patent and that said Letters Patent are hereby corrected as shown below:

Column 1, line 33, "dialtyl" should read -- dialkyl --.

Column 1, line 31, "have above" should read -- above --.

Column 1, line 48, "75° F." should read -- -75°F. --.

Column 1, line 49, "1-octadecone" should read -- 1-octadecene --.

Column 2, line 4, "210°10F" should read -- 210°F. --.

Column 2, line 35 "compositio suitablle" should read -- composition suitable --.

Column 2, line 38, "lubriants" should read -- lubricants --.

Column 2, line 46, "Synthetic" should read -- synthetic --.

Column 4, line 18, "decene-dimeter" should read -- decene-dimer --.

Column 4, line 43, "80°" should read -- 80% --.

Column 5, line 19, "120°-°F." should read -- 120-140°F. --.

Column 5, line 46, "Exampple" should read -- Example --.

Column 6, line 12, "alunimum" should read -- aluminum --.

Column 6, line 43, "Librizol" should read -- Lubrizol --.

Column 8, line 39, "comprising" should read -- comprises --.

UNITED STATES PATENT OFFICE

CERTIFICATE OF CORRECTION

Patent No. 4,035,308 Dated July 12, 1977

Inventor(s) Thomas Anthony Schenach

It is certified that error appears in the above-identified patent and that said Letters Patent are hereby corrected as shown below:

Column 8, line 45, "alunimum" should read -- aluminum --.
Column 8, line 49, "n-dencene-1" should read
-- n-decene-1 --.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*